US008782843B2

(12) United States Patent
Ludtke et al.

(10) Patent No.: US 8,782,843 B2
(45) Date of Patent: Jul. 22, 2014

(54) FLOOR FINISH APPLICATION PAD AND METHOD

(75) Inventors: Nathan E. Ludtke, Racine, WI (US); Glenn Weaver, Racine, WI (US); Axel Schmitz, Gommiswald (CH); Shwn-Meei Linden, Racine, WI (US)

(73) Assignee: Diversey, Inc., Sturtevant, WI (US)

( * ) Notice: Subject to any disclaimer, the term of this patent is extended or adjusted under 35 U.S.C. 154(b) by 762 days.

(21) Appl. No.: 12/864,547

(22) PCT Filed: Jan. 23, 2009

(86) PCT No.: PCT/US2009/031858

§ 371 (c)(1),
(2), (4) Date: Oct. 26, 2010

(87) PCT Pub. No.: WO2009/094555

PCT Pub. Date: Jul. 30, 2009

(65) Prior Publication Data

US 2011/0047737 A1 Mar. 3, 2011

Related U.S. Application Data

(60) Provisional application No. 61/023,626, filed on Jan. 25, 2008.

(51) Int. Cl.
*A47L 25/00* (2006.01)

(52) U.S. Cl.
USPC ..... 15/228; 15/208; 15/209.1

(58) Field of Classification Search
USPC ..... 15/208, 209.1, 228
See application file for complete search history.

(56) References Cited

U.S. PATENT DOCUMENTS

| | | | |
|---|---|---|---|
| 3,072,952 | A | 1/1963 | Cox |
| 5,090,832 | A | 2/1992 | Rivera et al. |
| 6,045,622 | A | 4/2000 | Holt et al. |
| 6,503,615 | B1 | 1/2003 | Horn et al. |
| 2004/0086320 | A1 | 5/2004 | Policicchio et al. |

FOREIGN PATENT DOCUMENTS

| | | | |
|---|---|---|---|
| CN | 1160528 | A | 10/1997 |
| CN | 1202094 | A | 12/1998 |
| FR | 2967884 | | 6/2012 |
| JP | 2000-325859 | | 11/2000 |
| JP | 2001-355176 | | 12/2001 |
| JP | 2004-223022 | | 8/2004 |
| KR | 10-2005-0053632 | | 6/2005 |
| WO | 98/23199 | | 6/1998 |

OTHER PUBLICATIONS

International Search Report from PCT/US2009/031858, prepared by the Korean Intellectual Property Office.
EP14159852.4 Extended European Search report dated Apr. 29, 2014 (7 pages).

*Primary Examiner* — Lee D Wilson
*Assistant Examiner* — Shantese McDonald
(74) *Attorney, Agent, or Firm* — Michael Best & Friedrich LLP

(57) ABSTRACT

A floor finish application apparatus and method for applying floor finishes to a floor. The floor finish application apparatus can include an applicator pad, which in some embodiments comprises filter material. In some embodiments, the filter material is air filter material, and has certain wet and/or dry friction characteristics, density, thickness, compressive resistance, liquid absorptive capacity, porosity, spreading capability, and/or leveling capability. In some embodiments, the pad has a stepped or otherwise uneven height.

15 Claims, 5 Drawing Sheets

FLOOR FINISH APPLICATION PAD AND METHOD

BACKGROUND OF THE INVENTION

Mop-like assemblies of the type used for applying floor finishes (e.g., floor wax, polyurethane, or other floor finishing or floor sealing materials, etc.) to a surface such as the surface of a floor are well known, and are hereinafter generally referred to interchangeably as floor finish application tools or assemblies. Some conventional floor finish application tools generally include a floor finish application head and a handle pivotally attached to the head. In many cases, a valve assembly is mounted on the handle adjacent the head and in fluid communication with the floor finish to control the flow of floor finish from a reservoir to the floor. The valve is normally closed to stop the flow of floor finish through the valve, but can be manually opened to allow the floor finish to flow through the valve to be deposited on the floor at a position close to the head. The floor finish is spread over the surface by the head, or more specifically, by an applicator pad coupled to the head. These conventional assemblies typically do not accurately control the amount of floor finish applied to a floor at a reasonable cost to be considered disposable.

SUMMARY OF THE INVENTION

The present invention relates to a floor finish application pad and/or method of applying floor finishes to a floor.

Some embodiments also feature a unique floor finish applicator pad that is useful for applying floor finishing compositions onto a substrate surface, such as a floor.

In some embodiments, the floor finish application pad comprises a material having a tri-dimensionally extending network of intercommunicated voids.

Some embodiments of the present invention relate to a method of applying a protective floor finish to a floor, wherein the method comprises providing a floor finish application tool, actuating a valve assembly from a closed position to an open position, dispensing floor finish onto the floor in response to actuating the valve assembly to the open position, and spreading the dispensed floor finish across the floor with the pad.

In some embodiments of the present invention, a floor finish applicator pad is provided, and comprises a body comprising a sheet of air filter material having a first side and a second side opposite the first side and more fluid absorbent than the first side; a leading edge; and a trailing edge having a thickness different from that of the leading edge.

Some embodiments of the present invention provide a floor finish applicator pad, comprising: a leading edge; a trailing edge; and an air filter sheet having a first side; a second side opposite the first side and more fluid absorbent than the first side; and a fold at least partially defining one of the leading and trailing edges of the applicator pad and having at least a double layer of the air filter sheet, the fold further defining a first portion of the applicator pad in which the second side of the air filter sheet is oriented to engage a floor surface; wherein a second portion of the applicator pad is at least partially defined by the air filter sheet, the first side of the air filter sheet at the second portion oriented to engage the floor surface.

In some embodiments of the present invention, a floor finish applicator pad is provided, and comprises: a body having: leading and trailing edges joined by lateral sides; and a ground-engaging surface; the body comprising filter material having a density greater than about 0.01 g/cm$^3$ and less than about 0.08 g/cm$^3$, and a thickness greater than about 0.3 cm and less than about 2.5 cm.

Further aspects of the present invention, together with the organization and operation thereof, will become apparent from the following detailed description of the invention when taken in conjunction with the accompanying drawings.

DETAILED DESCRIPTION

Figure 1:
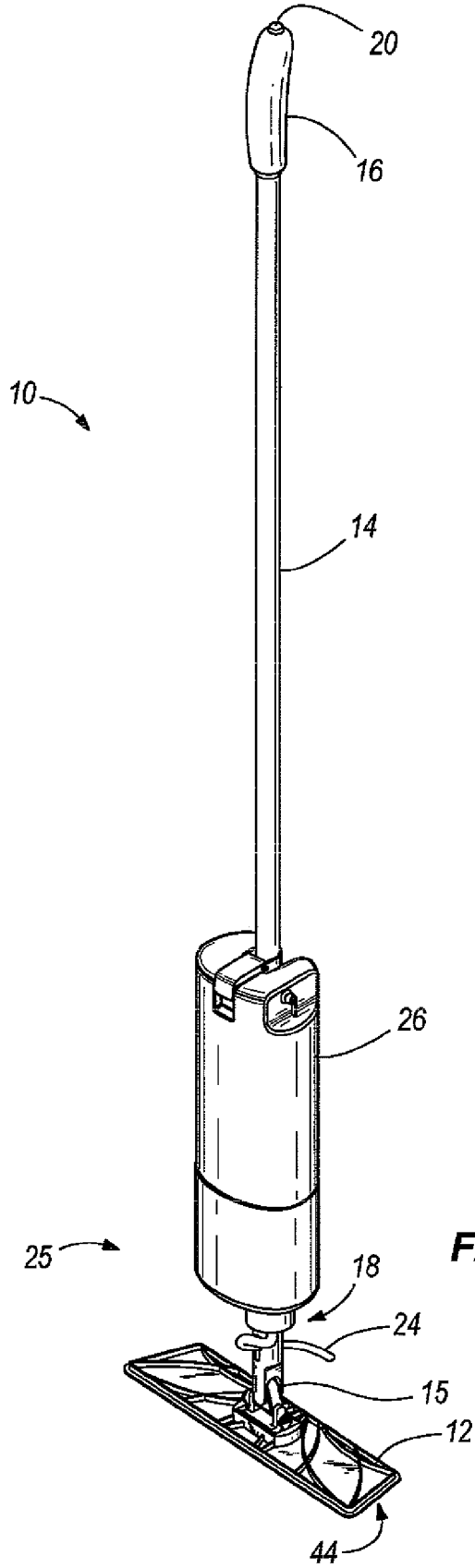
FIG. 1 is a perspective view of a floor finish application tool having a pad embodying aspects of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

Referring now to FIG. 1 of the drawings, there is illustrated a exemplary floor finish application tool 10 that can be utilized with pads according to embodiments of the present invention. The illustrated tool is designed and configured to apply a floor finish to a floor. In some applications, the floor finish can be a composition capable of providing a temporary or permanent protective coating, typically a clear coating, onto the surface of the floor. For example, the floor finish can be a floor coating or sealer. Further, various embodiments of the pad according to the present invention are configured to apply a substantially consistent and uniform layer of floor finish to a floor regardless of force applied to the tool by an operator, or at least through a broad range of such pressures. Although a specific tool is illustrated and described herein, the illustrated tool is not limiting upon the present invention. Rather, substantially any other application tool can be used with the pads according to the present invention.

The illustrated floor finish application tool 10 comprises a floor finish application head 12, an elongated handle 14 having a first (or distal) end 15 pivotally attached to the head 12, and a portion adjacent an opposite second (or proximal) end 16 that is adapted to be manually engaged by an operator to move the head 12 along a floor or other surface.

The illustrated floor finish application tool 10 also has a valve assembly 18 with a valve (not shown) for controlling dispense of fluid from the tool 10. In some embodiments, the valve assembly 18 is positioned adjacent the first end 15 of the handle 14, and is operable to regulate the flow of floor finish from a reservoir 26 to the floor. The valve assembly 18 has an open position in which the valve assembly 18 permits floor finish to flow to the floor, and a closed position in which the valve assembly 18 does not permit floor finish to flow to the floor (or more specifically, through a conduit positioned in the valve assembly 18). In some embodiments, the valve assembly 18 can have multiple predefined open positions corresponding to multiple flow rates. Although the valve assembly 18 can be configured in a number of different manners, in the illustrated embodiment the valve assembly 18 has a pinch valve configuration.

As illustrated in FIG. 1, an actuator 20 is coupled to the handle 14 to actuate the valve assembly 18. The actuator 20 allows an operator to control or selectively dispense floor finish from the reservoir 26. The actuator 20 can be coupled to the handle 14 in any suitable location (e.g., anywhere along the handle 14) and can take a number of different forms (e.g., lever, button, dial, and the like). For example, as illustrated in FIG. 1, the actuator 20 is a push button, and is located on the second end 16 of the handle 14. However, in other embodiments, the actuator 20 can be located in a number of other positions adjacent the second end 16, or in many other positions along the handle 14. Further, the configuration of the actuator 20 can be modified as well. For example, the actuator 20 can have a trigger configuration or other configurations known in the art. The actuator 20 can be coupled to the valve assembly 18 via one or more linkages, rods, cables, other force transmission assemblies, and the like. In some embodiments, the actuator 20 can be or include an electronic actuator (e.g., electrical switch, button, and the like). Also, in some embodiments, an actuator is not necessary.

Some floor finish application tools, such as the one illustrated in FIG. 1, include a floor finish delivery system 25. The floor finish delivery system 25 can include a permanent or replaceable floor finish reservoir 26 having a conduit 24 extending from the reservoir 26 (e.g., from an opening of the reservoir 26) to direct floor finish toward a location on the floor, such as adjacent the head 12. The floor finish delivery system 25 can include one or more nozzles, spray heads, or other devices used to deliver, and in some cases distribute, fluid upon the floor. Such devices can be coupled to the floor finish reservoir 25 by the conduit 24, or can be directly connected to the floor finish reservoir 26. In some embodiments, the floor finish delivery system 25 is intended only for a single use. As such, once the reservoir 26 is depleted, the floor finish delivery system 25 is replaced with a new floor finish delivery system 25. This configuration substantially eliminates the possibility of clogging and the time-consuming maintenance related to such clogs.

The reservoir 26 can take a number of different forms. For example, the reservoir 26 can comprise a bag, a substantially rigid vessel or container, and the like. The reservoir 26 can also have an opening closed by a screw cap, plug, or other suitable closure mechanism through which opening the container can be dispensed, and in some embodiments refilled. In some embodiments, the reservoir 26 can be provided with a non-removable closure mechanism to prevent the floor finish delivery system from being reused, which may prevent related clogging issues of reuse.

As mentioned above with regard to the illustrated embodiment of FIG. 1, a conduit 24 can extend from the opening of the reservoir 26 toward a floor surface to deliver floor finish from the reservoir 26 to the floor. The conduit 24 can take a number of different suitable forms.

As discussed above, the second end 15 of the handle 14 is coupled to the head 12. Specifically, the second end 15 of the illustrated handle 14 is pivotally coupled to the head 12 via a joint, such as a ball joint, universal joint, hinge, and the like. The head 12 can include fastening structure for fastening a floor finish application pad 44 to the head 12. This fastening structure can include substantially any fastening structure known in the art, such as mechanical fasteners like hook and loop fasteners or fastening material, elastic grabbing members, pinching members, pockets received by the head, and the like.

Figure 2:
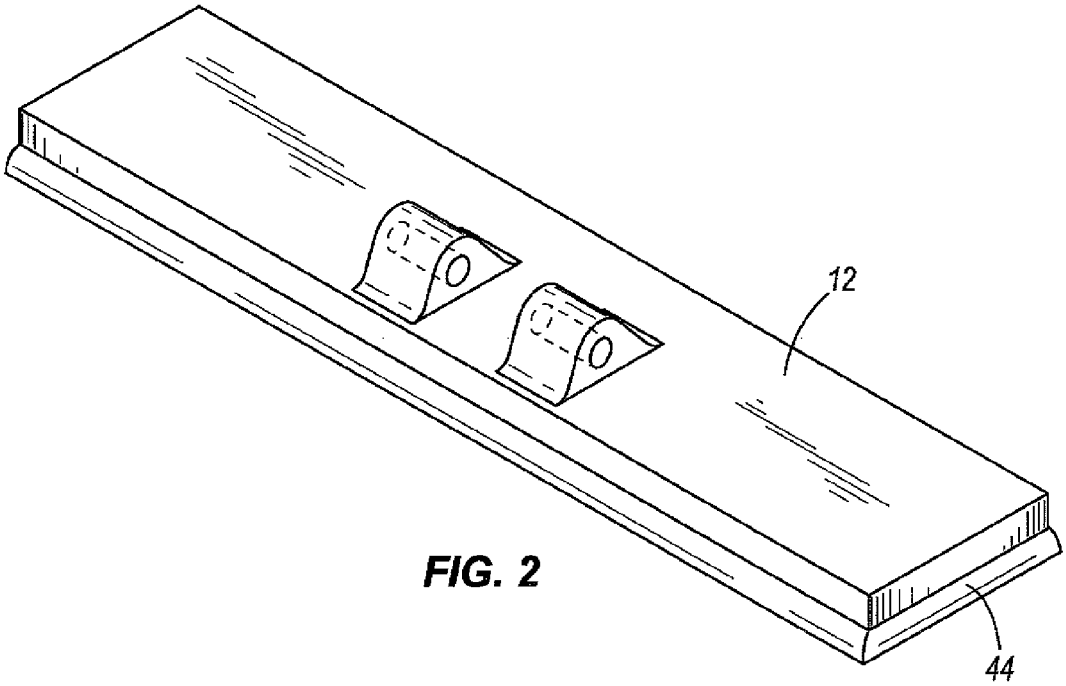
FIG. 2 is a perspective view of a pad and a finish application tool head according to some embodiments of the present invention.
Figure 3:
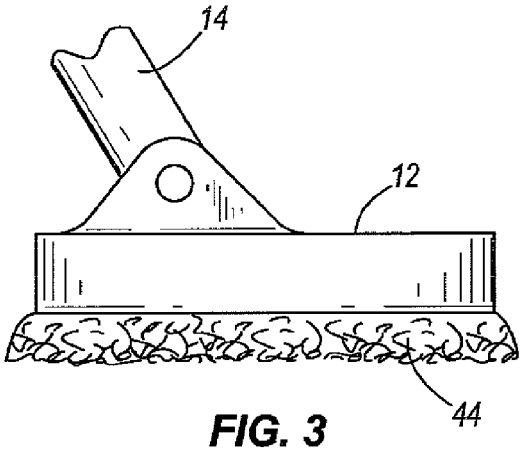
FIG. 3 is a side view of the pad and head illustrated in FIG. 2.
Figure 4:
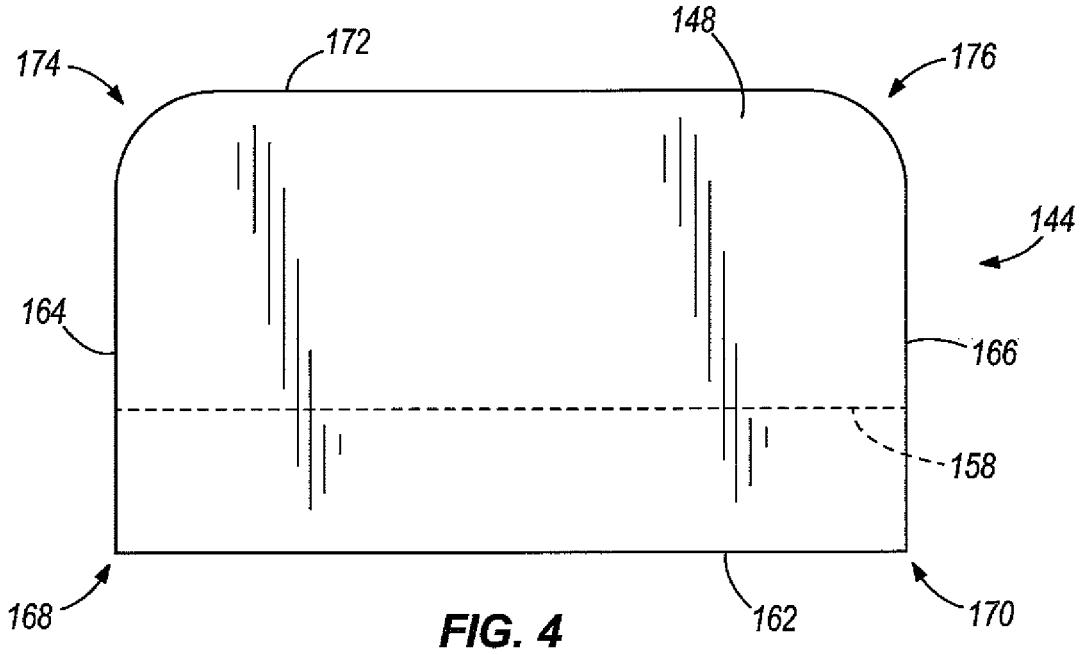
FIG. 4 is a bottom view of a pad according to an alternate embodiment of the present invention.
Figure 5:
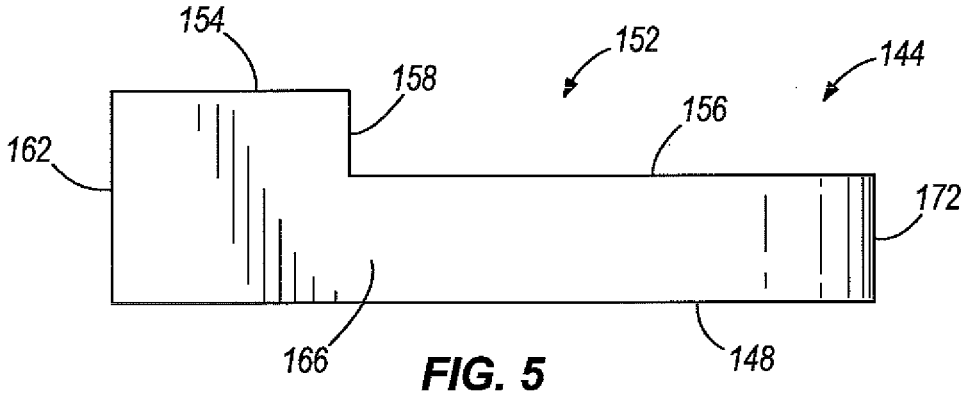
FIG. 5 is a side view of the pad illustrated in FIG. 4.

The floor finish application pad 44 can have a number of different shapes based at least in part upon the shape of the head 12, the manner of connection of the pad 44 and head 12, and the type of floor finish to be spread by the pad 44. In some embodiments, the pad 44 is substantially flat as shown in the embodiment of FIGS. 1-3, and can be constructed of a body of material having one or more layers of the same or different thicknesses. However, in other embodiments, the pad 44 has other shapes adapted for particular movement and floor finishing operations performed by the tool 10. An example of such a shape is illustrated in FIGS. 4 and 5. The applicator pad 144 illustrated in FIGS. 4 and 5 includes a substantially planar first surface 148, a stepped second surface 152, first and second pad portions 154, 156, and a step 158 therebetween. Although either or both first and second portions 154, 156 can be constructed of a single layer of the same or different materials described in greater detail below, either or both portions 154, 156 can be constructed of any number of additional layers as desired. For example, the second portion 156 in the illustrated embodiment of FIGS. 4 and 5 can comprise two layers of material, whereas the first portion 154 can comprise three layers of material. The first portion 154 has a greater height than the second portion 156 to promote better spreading of fluid, and to inhibit fluid flowing over the top of the pad 144.

In some embodiments, the applicator pad 144 is positioned such that the first surface 148 engages a floor or other surface (hereinafter referred to simply as a "floor surface" or "floor" for ease of description). In other embodiments, the applicator pad 144 is positioned such that the stepped second surface 152 engages the floor. In some embodiments, it may be desirable to engage the floor with a flat surface, based upon a number of factors, including the viscosity of floor finish to be moved by the applicator pad 144, the absorbency of the applicator pad 144, and the like. However, when a non-flat surface (e.g., stepped second surface 152) engages the floor, various unique properties, such as reduced drag or friction, can result. For example, while not subscribing to any specific theory or suggesting that the applicator pad 144 must be in any particular orientation with respect to a floor, the inventors have found that engaging a floor with a smaller surface area, such as with a non-flat surface (e.g., with the front surface 162 shown in FIGS. 4 and 5 contacting the finish first), results in lower drag and can result in a more even coating of floor finish or other fluid.

The illustrated applicator pad 144 further includes a substantially planar front surface 162 extending between first and second side surfaces 164, 166, respectively. First and second corners 168, 170 are positioned between the front surface 162 and the respective first and second side surfaces 164, 166. The first and second corners 168, 170 can form a right angle between the front surface 162 and the first and second side surfaces 164, 166, thereby permitting an operator to move fluid into corners or other restricted spaces.

The illustrated applicator pad 144 additionally includes a rear surface 172. Third and fourth corners 174, 176 can be positioned between the rear surface 172 and the respective first and second side surfaces 164, 166 of the applicator pad 144. The third and fourth corners 174, 176 can be curved (e.g., see FIG. 4), and can move fluid back to a middle of the applicator pad 144 to inhibit fluid leakage or streaking during fluid application.

In some embodiments, the applicator pad 144 can have a width of between about 40 cm and about 60 cm between first and second side surfaces, 164, 166. In some embodiments, the length of the applicator pad 144 is between about 11 cm and about 12 cm between the front surface 162 and the rear surface 172. Also, in some embodiments, the first portion 154 of the applicator pad 144 extends less than half (e.g., about one third) of the length between the front surface 162 and the rear surface 172. In other embodiments, the first portion 154 extends greater than half (e.g., about two thirds) of the length between the front surface 162 and the rear surface 172.

In some embodiments, the applicator pad 144 includes one or more layers of air filter material, the properties of which are described in greater detail below. The material can be found in sheet form having thicknesses that are also described below, and can be stacked, folded, and/or interfolded in different manners to achieve different unique properties of the applicator pad 144. Some features of sheet materials that can have a significant impact upon the characteristics of the applicator pad 144 include the smoothness and absorbency of the sheet material used to construct the applicator pad 144. These features can be different on opposite sides of the sheet materials. For example, some sheet materials according to the present invention are relatively smooth on one side and relatively rough on an opposite side (i.e., generating different frictional resistances when dragged across another surface). As another example, these and other sheet materials can have one side that is more fluid permeable and/or fluid absorbent than another, and in some cases can have one side that is fluid impermeable or substantially fluid impermeable, and an opposite side that is fluid permeable. As will now be described, the construction of applicator pads according to some embodiments of the present invention is based at least in part upon the use of sheet materials (e.g., air filter sheet materials) having different properties on opposite sides of the sheet materials.

Additional non-flat applicator pad embodiments according to the present invention are illustrated in FIGS. 6-11. The embodiments shown in FIGS. 6-11 are numbered in respective hundreds series (244, 344, 444, 544, 644, 744). In these embodiments, the applicator pads 244, 344, 444, 544, 644, 744 have differing heights or different configurations between the front and back of the applicator pads 244, 344, 444, 544, 644, 744. In some embodiments, sheet material having different properties (e.g., smoothness and/or absorbency, as described above) on opposite sides of the sheet material is used.

Figure 6:
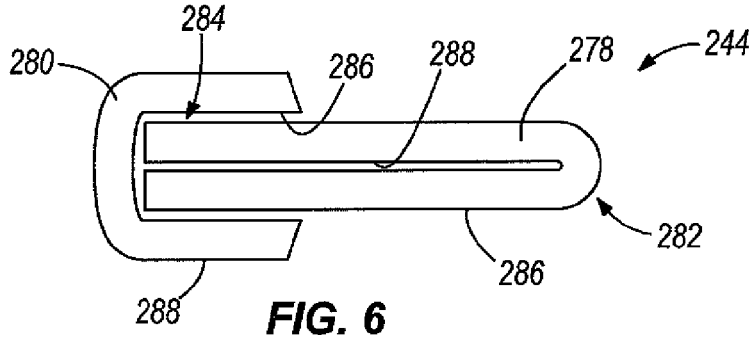
FIG. 6 is a side view of a pad according to some embodiments of the present invention.

With reference to the embodiment of FIG. 6 the applicator pad 244 illustrated therein includes a first length of material 278 and a second length of material 280. In some embodiments, the first and second lengths of material can be constructed of the same or similar type of sheet material (i.e., having the same or similar properties). The first length of material 278 is folded in half to form a folded end 282 and an open end 284, while the second length of material 280 is folded over the open end 284. The applicator pad 244 can engage the floor with a non-flat surface, similar to the applicator pad 144 described above. The first length of material 278 can be the same as or different than the second length of material 280. In some embodiments, the first length of material 278 is the same as the second length of material 280. However, both lengths of material 278, 280 in the illustrated embodiment of FIG. 6 include a first side 286 and second side 288 that have different properties. For example, the first side 286 can have a surface that is substantially fluid impermeable, whereas the second side 288 can have a more fluid absorbent surface that can also have better spreading capability. In general, the more fluid absorbent surface of the second side 288 can be rougher (and in some cases, softer) than the surface of the first side 286. In other words, the substantially fluid impermeable or less fluid permeable surface of the first side 286 can be smoother (and in some eases, less soft) than the surface of the second side 288. Engaging the floor with both the first side 286 and the second side 288 at different portions of pad 244 can allow for more even spreading of fluid with reduced drag. In this regard, fluid can be at least partially absorbed within and pushed by the second length of material 280 while being prevented from loading the first length of material 278 by virtue of the less fluid absorbent (and in some cases, fluid impermeable) exposed side of the second length of material.

Although the opposite edges of the first and second lengths of material 278, 280 shown in FIG. 6 are substantially vertically aligned with one another in FIG. 6, such alignment is not required. For example, in other embodiments, the top and bottom edges of the second length of material 280 can cover any portion of the top and bottom of the first length of material 278, respectively, while still resulting in an applicator pad 244 in which the second length of material 280 is folded over an open end 284 of the first length of material 278. As another example, the opposite edges of the first length of material 278 can be offset from one another while still resulting in an applicator pad 244 as just described. Furthermore, although only one fold is shown in the first length of material 278 described above, any number of additional folds can be provided in the first length of material 278 while still providing an applicator pad 244 having a relatively smooth and/or fluid impermeable exterior surface as described above.

Figure 7:
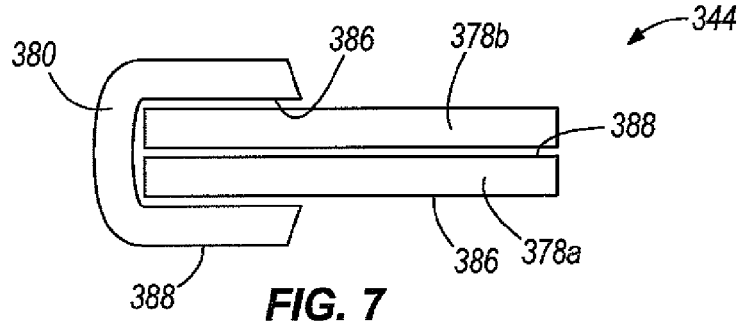
FIG. 7 is a side view of a pad according to some embodiments of the present invention.

The applicator pad 244 illustrated in FIG. 7 differs from the applicator pad 244 of FIG. 6 in that a first length of material 378 is cut into two separate pieces **378*a*, 378*b*, rather than being folded. In some embodiments, the piece 378*a* is the same material (i.e., has the same properties) as piece 378*b*, whereas in other embodiments, piece 378*a* is a different material than piece 378*b*. Further, piece 378*a* is oriented such that a relatively less fluid absorbent (and in some cases, smooth) first side 386 contacts the floor and a rougher (and in some cases softer), more absorbent second side 388 faces generally away from the floor. Piece 378*b* can be oriented in the same manner as piece 378*a*, or can be oriented in an opposite manner. The orientation of piece 378*b* is not noted in FIG. 7 to further illustrate that the orientation of the piece 378***b* can be less important than the orientation of piece 378*a* in some embodiments of the present invention. The second length of material 380 is folded over the pieces 378*a*, 378*b* in an orientation such that the first side 386 contacts the pieces 378*a*, 378*b* and the second side 388 contacts the floor. Reference is hereby made to the embodiment of FIG. 6 for further description regarding the features of the embodiment of FIG. 7 and the alternatives thereto.

Figure 8:
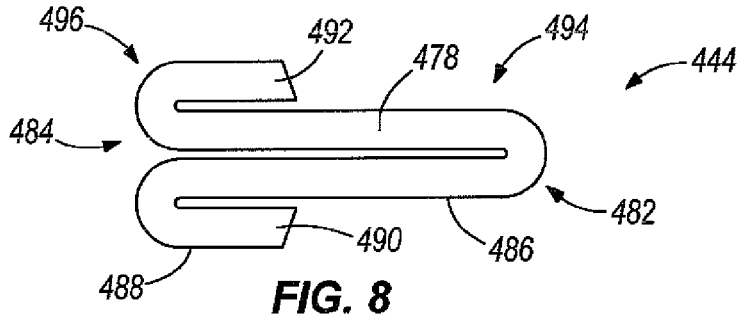
FIG. 8 is a side view of a pad according to some embodiments of the present invention.

The applicator pad 444 illustrated in FIG. 8 includes a first length of material 478 having a first end 490 and a second end 492, and that is folded in half to form a folded portion 494 having a folded end 482 and an open end 484. The first end 490 and second end 492 are folded back upon the length of material at the open end 484 to each form a double-folded portion 496. Like the lengths of material described above in connection with FIGS. 6 and 7, the length of material 478 in the illustrated embodiment of FIG. 8 includes a first side 486 and second side 488 that have different properties. For example, the first side 486 can have a substantially less absorbent surface that is substantially fluid impermeable, whereas the second side 488 can have a rougher (and in some cases softer), more fluid absorbent surface. Therefore, the folded portion 494 of the applicator pad 444 illustrated in FIG. 8 includes a smooth first side 486 that contacts the floor and a rough second side 488 spaced from the floor, whereas the double-folded portion 496 positions the second side 488 adjacent the floor with the first side 486 spaced from the floor. Engaging the floor with both the first side 486 and the second side 488 at different portions of pad 444 can allow for more even spreading of fluid with reduced drag. In this regard, fluid can be at least partially absorbed within and pushed by the double-folded portion 496 of the length of material 478 while being prevented from loading the folded portion 494 of the length of material 478 by virtue of the less fluid absorbent (and in some cases, fluid impermeable) exposed side of the length of material 478 at the folded portion 494.

Although the opposite ends 490, 492 of the length of material 478 shown in FIG. 8 are substantially vertically aligned with one another in FIG. 8, such alignment is not required. For example, in other embodiments, the opposite ends 490, 492 of the length of material 478 can cover any portion of the folded portion 494, while still resulting in an applicator pad 444 having a double-folded portion 496 with exposed rougher and/or more fluid permeable and absorbent side 488 and a folded portion 494 with exposed smoother and/or less fluid permeable (and in some embodiments, fluid impermeable) side 486. Furthermore, although the folded portion 494 is shown in FIG. 8 as having only one fold, the folded portion 494 can have any number of additional folds of the same or different lengths while still providing an applicator pad 444 having a relatively smooth and/or fluid impermeable exterior surface as described above. Also, although the folded portion 496 is shown in FIG. 8 as having only a single fold at a top and bottom of the applicator pad 444, any number of additional folds of the same or different lengths can be located at the top and/or bottom of the applicator pad 444 in such locations while still providing an applicator pad 444 having a relatively rough and/or fluid permeable external surface as described above.

Figure 9:
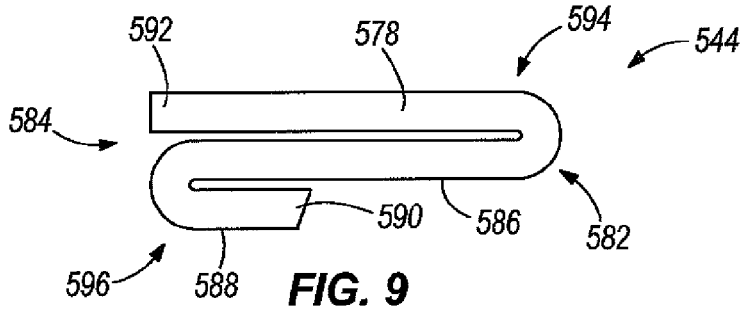
FIG. 9 is a side view of a pad according to some embodiments of the present invention.

The applicator pad 544 illustrated in FIG. 9 differs from the applicator pad 444 of FIG. 8 in that only one end 590 (e.g., bottom end 590) of the first length of material 578 is folded upon itself. Like the applicator pad 444 of FIG. 8, the first length of material 578 is folded in half to form a folded portion 594 having a folded end 582 and an open end 584. The first end 590 is folded back at the open end 584, and is folded against the first sheet of material 578 to form a double-folded portion 596. Accordingly, the folded portion 594 includes a smooth and/or less fluid permeable first side 586 that contacts the floor and a rougher (and in some cases, softer) and/or more fluid permeable and absorbent second side 588 that is spaced from the floor, whereas the double-folded portion 596 includes a smooth and/or less fluid permeable first side 586 spaced from the floor and the rougher and/or more fluid permeable second side 588 in engagement with the floor. Reference is hereby made to the embodiment of FIG. 8 for further description regarding the features of the embodiment of FIG. 9 and the alternatives thereto.

Figure 10:
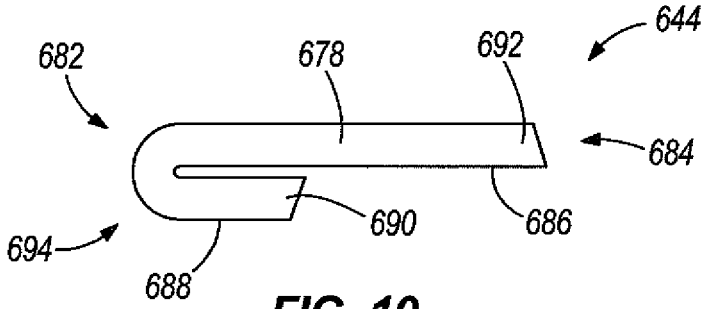
FIG. 10 is a side view of a pad according to some embodiments of the present invention.

The applicator pad 644 illustrated in FIG. 10 differs from the applicator pad 444 of FIG. 8 in that the applicator pad 644 only includes a single fold. The applicator pad 644 illustrated in FIG. 10 includes a first length of material 678 having a first end 690 and a second end 692. The first end 690 is folded against the length of material 678 to form a folded portion 694 having a folded end 682 and an open end 684. Like the lengths of material described above in connection with FIGS. 6-9, the length of material 678 in the illustrated embodiment of FIG. 10 includes a first side 686 and second side 688 that have different properties. For example, the first side 686 can have a substantially smooth surface that is substantially fluid impermeable, whereas the second side 688 can have a rougher (and in some cases, softer) more fluid absorbent surface. The folded end 682 of the applicator pad 644 illustrated in FIG. 10 includes a rough second side 688 that contacts the floor, and the open end 684 includes a smoother, less fluid permeable first side 686 that contacts the floor. Engaging the floor with both the first side 686 and the second side 688 at different portions of the pad 644 can allow for more even spreading of fluid with reduced drag. In this regard, fluid can be at least partially absorbed within and pushed by the folded end 682 of the length of material 678 while being prevented from loading the second end 692 of the length of material 678 by virtue of the less fluid absorbent (and in some cases, fluid impermeable) side of the length of material 678 facing a floor surface at the second end 692. Although the length of material 678 folded upon itself in the illustrated embodiment of FIG. 10 results in a double thickness extending along less than half of the width of the applicator pad 644, the length of material 678 can instead be folded so that at least half, and in some cases more than half of the width of the applicator pad 644 has a double thickness.

Figure 11:
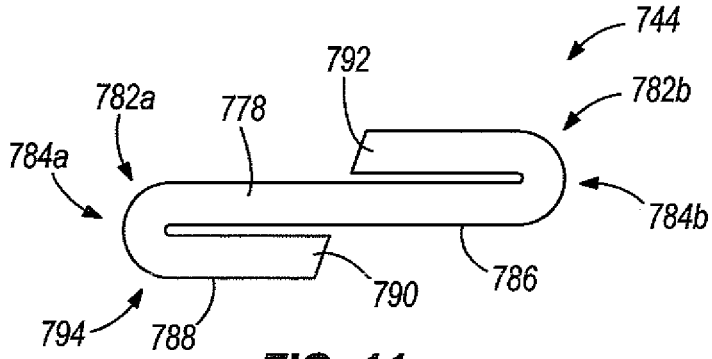
FIG. 11 is a side view of a pad according to some embodiments of the present invention.

The applicator pad 744 illustrated in FIG. 11 differs from the applicator pad 544 of FIG. 9 in that the length of material 778 in FIG. 11 is folded so that it has a double thickness across the width of the applicator pad 744, whereas the length of material 578 in FIG. 9 is folded so that it has a triple thickness at an end 584 of the applicator pad 544 (by virtue of the first end 590 being folded upon itself as described above). The first length of material 778 in the applicator pad 744 shown in FIG. 11 has a first end 790 and a second end 792. The first end 790 is folded back against the first length of material 778 to create a first folded portion 784*a* having a first folded end 782*a* and the second end 792 is folded back against the first length of material 778 to create a second folded portion 784*b* having a second folded end 782*b*. Like the lengths of material described above in connection with FIGS. 6-10, the length of material 778 in the illustrated embodiment of FIG. 11 includes a first side 786 and second side 788 that have different properties. For example, the first side 786 can have a surface that is substantially fluid impermeable (and in some cases, substantially smooth), whereas the second side 788 can have a rougher (and in some cases, softer), more fluid absorbent surface. Engaging a floor surface with both the first side 786 and the second side 788 at different portions of pad 744 can allow for more even spreading of fluid with reduced drag, as discussed above.

Although the opposite ends 790, 792 of the length of material 778 shown in FIG. 11 are substantially vertically aligned with one another in FIG. 11, such alignment is not required. For example, in other embodiments, the opposite ends 790, 792 of the length of material 778 can cover any respective portion of the length of material 778 (i.e., can extend across any portion of the width of the applicator pad 744) while still resulting in an applicator pad 744 having a first folded portion 784*a* with an exposed rougher (and in some cases, softer) and/or more fluid permeable and absorbent side 788, and a second folded portion 784*b* with an exposed smoother and/or less fluid permeable (and in some embodiments, fluid impermeable) side 786. Furthermore, although the folded portions 784*a*, 784*b* are shown in FIG. 11 as having only one fold, either or both of the folded portions 784*a*, 784*b* can have any number of additional folds of the same or different lengths. An advantage of an applicator pad 744 with folded portions 784*a*, 784*b* each defining a rougher (and in some cases, softer) and/or more fluid permeable and absorbent side 788 exposed on one side of the applicator pad 744, and a smoother and/or less fluid permeable (and in some embodiments, fluid impermeable) side 786 exposed on an opposite side of the applicator pad 744 is that the applicator pad 744 can be flipped over to present the same or similar applicator pad structure to a floor surface. Accordingly, the applicator pad 744 in such embodiments can be flipped over (once one side of the applicator pad 744 has been soiled or otherwise used to the degree desired) to be used again. The same can be said for pads according to other embodiments of the present invention disclosed herein (e.g., pads 244, 344, 444) provided that any fasteners needed to connect the flipped pad have not been damaged.

Applicator pads 44, 144, 244, 344, 444, 544, 644 and 744 according to various embodiments of the present invention can be constructed of a number of different materials having the performance and material characteristics described below. By way of example, such applicator pads 44, 144, 244, 344, 444, 544, 644 and 744 can be constructed of fibrous material, webs, foams, and other sponge-like materials, plastic elements, and the like. Exemplary floor finish finishing materials include, but are not limited to, polyester fibers, rayon, cotton, wool, polyolefins, polyamides such as nylons, and combinations thereof.

Applicator pads 44, 144, 244, 344, 444, 544, 644 and 744 according to various embodiments of the present invention may be fabricated using a number of well-known technique suitable for producing materials with the material characteristics described below.

In the development of applicator pads according to various embodiments of the present invention, multiple cleaning pads, cloths, and filters were tested for even floor finish distribution and for leveling out uneven surfaces. Three materials showed unexpected results when used to distribute floor finish over a surface. The first two materials are air filter materials available under the product designation HF 40 HS1S (hereinafter, "HF40") and HF 32D available by Ahlstrom Corporation, Helsinki, Finland, while the third material is the air filter material available from Nox-Bellcow, Zhongshan, China (hereinafter "Nox"). It was unexpected and surprising that air filter material would perform as good as or better than conventional scrub pads and applicator pads. In order to determine material properties that could improve floor finishing performance, various tests were run to determine material properties for these three air filter materials, and many scrub pads and applicator pads that are readily available in the marketplace. For example, these materials were compared to various conventional pads relative to density, friction, compression resistance, porosity, spreading, absorbency, and the like.

Friction/Drag

During tests, it was observed that the air filter materials (i.e., HF40, HF32D and Nox) had surprisingly dramatic reduction in drag without compromising the quality of coatings achieved. As such, various tests were conducted to test these observations. Specifically, the coefficient of friction was calculated on the same surface for a variety of conventional materials and compared to the air filter material. Three different tests were conducted. One test determined the dry coefficient of friction (static and dynamic) relative to the common surface. The second determined the wet coefficient of friction (static and dynamic) relative to the common surface. The third was a measure of the coefficient of static friction utilizing the James Machine.

For both the first and second friction test noted above, six inch diameter samples of material were separately dragged over a coated tile surface (black VCT from Armstrong with 4 coats of Carefree® floor finish, available from JohnsonDiversey, Inc.) under a set vertical force (Z-force) using a Precision Force Instrument. One cycle of testing included moving the pad from one side of a tile to an opposite side of the tile, and then moving the pad in an opposite direction across the tile. Each pad was dragged over the tile for two cycles (total of 4 passes) with a pause included between cycles. Pad position, running time and both horizontal (X) and vertical force (Z) were recorded at the rate of 100 data points per second during the run. The first peak forces (or static forces) in the horizontal (X) were detected in the beginning of each pass when the pad started to move across the tile, while a lower force (or dynamic force) in the horizontal (X) direction was detected while the pad was moving across the tile. The average (through out whole pass) and first peak (static) coefficients of friction were calculated respectively by dividing the average X-force (whole pass) by average Z-force (whole pass) and by dividing the first peak X-force (static) by the Z-force at that point. The average coefficient should be very slightly higher and could be viewed as a dynamic coefficient. For the dry test, the materials were not moistened. For the wet test, the materials were moistened with 25 mL of water to partially simulate use conditions. This data is included Table I—wet and Table I—dry below.

TABLE I

| wet | | | | | | | |
|---|---|---|---|---|---|---|---|
| Low to high COF-static | Sample ID | COF-static | COF-avg. | XF-1st peak, lb | ZF at 1st XF peak, lb | XF-avg lb | ZF-avg lb |
| #1 | HF40, fuzzy side | 0.39 | 0.24 | 5.792 | 14.855 | 3.612 | 14.790 |
| #2 | Jonmaster white pad | 0.44 | 0.27 | 6.137 | 14.089 | 3.762 | 13.854 |
| #3 | HF 32D | 0.45 | 0.26 | 6.767 | 15.007 | 3.854 | 14.989 |

TABLE I-continued

| wet | | | | | | | |
|---|---|---|---|---|---|---|---|
| Low to high COF-static | Sample ID | COF-static | COF-avg. | XF-1st peak, lb | ZF at 1st XF peak, lb | XF-avg lb | ZF-avg lb |
| #4 | HD yellow stripe pad | 0.50 | 0.32 | 6.807 | 13.745 | 4.292 | 13.598 |
| #4 | Rubbermaid Q800 pad | 0.50 | 0.33 | 6.869 | 13.788 | 4.536 | 13.592 |
| #6 | Tuway green pad | 0.75 | 0.47 | 10.170 | 13.554 | 6.198 | 13.320 |
| #7 | Padco, short fiber/thin sponge | 1.09 | 0.39 | 15.677 | 14.384 | 5.495 | 14.100 |

TABLE I

| dry | | | | | | | |
|---|---|---|---|---|---|---|---|
| Low to high COF-static | Sample ID | COF-static | COF-avg. | XF-1st peak, lb | ZF at 1st XF peak, lb | XF-avg lb | ZF-avg lb |
| #1 | Jonmaster white pad | 0.38 | 0.26 | 5.367 | 14.114 | 3.667 | 13.988 |
| #1 | HF40, fuzzy side | 0.38 | 0.28 | 5.713 | 15.205 | 4.161 | 15.079 |
| #3 | Rubbermaid Q800 pad | 0.44 | 0.31 | 6.080 | 14.298 | 4.353 | 14.014 |
| #4 | HF 32D | 0.49 | 0.32 | 7.604 | 15.534 | 4.905 | 15.474 |
| #5 | HD yellow stripe pad | 0.55 | 0.34 | 7.737 | 14.185 | 4.755 | 14.047 |
| #6 | Tuway green pad | 0.65 | 0.38 | 10.121 | 15.456 | 5.881 | 15.372 |
| #6 | Padco, short fiber/thin sponge | 0.65 | 0.40 | 9.303 | 14.405 | 5.651 | 14.129 |

The sample with the lowest static coefficient of friction values was the filter material (HF40). From the results in Table I—wet, the HF40 filter material demonstrated a static coefficient of friction of about 0.39 and a dynamic coefficient of friction of about 0.24 when wet, which are substantially less than the other materials tested. HF32D filter material demonstrated a static coefficient of friction of about 0.45 and a dynamic coefficient of friction of about 0.26 when wet, which are substantially less than the other materials tested. From the results in Table I—dry, the HF40 filter material demonstrated a static coefficient of friction of about 0.38 and a dynamic coefficient of friction about 0.28 when dry, which are substantially less than the other materials tested.

The inventors have discovered that in some pad embodiments according to the present invention, the static coefficient of friction tested according to the above-described test method is less than about 0.75. In some embodiments, the static coefficient of friction is less than about 0.55. In still other embodiments, this static coefficient of friction is less than about 0.45.

As indicated above, the materials were also tested using the James Machine Test (ASTM D-2047). This test is generally used to measure the coefficient of static friction of a polish-coated flooring surface relative to a standard "shoe" as a safety measure. Specifically, this test normally uses a piece of leather attached to a metal plate as a "shoe," and places the "shoe" on top of the floor surface under a set vertical force. The floor material is then moved laterally until the shoe slips under the force. The point at which the shoe slips relative to the floor is the measure of the coefficient of static friction.

The James Machine Test was also adapted to determine the coefficient of static friction for each of these materials relative to an unmodified (i.e., no additional coatings applied) 12 inch by 12 inch Armstrong new black vinyl composite tile. In this modified test, a three inch by three inch sample of material was attached to the "shoe". The new tile was lightly wiped with non-link tissue between tests to remove any particles from the tile. The average static coefficients of friction for the pad materials are included below in Table II.

TABLE II

| Sample ID | Coefficient of Friction Average of 4 readings | Mop drags experienced (1-lowest) |
|---|---|---|
| Justinus-1, groove "p" front edge | 0.24 | low |
| Glit 98, white pad | 0.24 | low |
| Ahlstrom HF40 HS1S, skin side | 0.24 | low |
| Justinus-1, groove "//" front edge | 0.24 | Not tested |
| Ahlstrom HF40 HS1S, fuzzy side | 0.24 | low |
| Nox-Bellcow, fuzzy side | 0.25 | Low |
| Jonmaster ProPolish white pad | 0.25 | low |
| Ahlstrom, HF32D | 0.25 | low |
| Daego disposable, white fuzzy side | 026 | low-medium |
| 3M 98, white pad | 0.27 | low-medium |
| Rubbermaid Q800 pad | 0.27 | low-medium |
| 3M Easy Shine applicator pad | 0.28 | low-medium |
| Daego disposable, green skin side | 0.28 | Not tested |
| Tuway green pad | 0.29 | high |
| Nox-Bellcow, skin side | 0.32 | low |
| Padco, short fiber/thin sponge, fiber side | 0.35 | high |
| Americo white drive, groove "//" front edge | 0.47 | Not tested |
| Americo white drive, groove "p" front edge | 0.48 | Not tested |
| Leather, as reference | 0.53 | Not tested |

The inventors have discovered that mop drags experienced in applying floor finishes have the same trend as the results from the modified James machine test described above. However, it was noticed that with the Nox-Bellcow material, the side of the material with the smoother surface presents an amount of friction that is most likely due to the biting of that surface into the tile under extreme high pressure (~8.9 lb per square inch)—a result that is many times higher than the head pressure on the pad (~0.02 to 0.2 lb per square inch) during the application. The inventors have discovered that in some pad embodiments according to the present invention, the static coefficient of friction tested according to the modified James Machine Test method should be less than about 0.32. In more preferred embodiments, the static coefficient of friction is less than about 0.28. In yet more preferred embodiments, this static coefficient of friction is less than about 0.26.

Density

As indicated above, density was also measure for a variety of materials to determine whether density helped provide the performance characteristics noted with the air filter materials. Many of the possible floor finish pads were tested under various circumstances to determine some material properties of the pads yielding desired floor finish application results. The height of sample stacks were measured according to ASTM D6571 with sample stacks sandwiched between two plates. The weight of the sample stacks were also measured, and these parameters were used to calculate the volume and the density of the samples. This data was collected, and is listed below in Table III. One will note that all samples were tested with multiple layers of the same material stacked to reduce the effects of sample variation.

TABLE III

| | Sample stacks | | | | Thickness | | Weight |
|---|---|---|---|---|---|---|---|
| | Height | Volume | Weight | Density | Sample stack per layer | | Per layer |
| | cm | $cm^3$ | g | $g/cm^3$ | # layer | cm | $g/m^2$ |
| Ahlstrom HF 32D | 13.5447 | 3047.55 | 56.266 | 0.019 | 24 | 0.564 | 104 |
| ETC thin Gorilla lite pad | 17.1563 | 3860.16 | 96.586 | 0.025 | 9 | 1.906 | 477 |
| Glit light duty tan pad | 13.1478 | 2958.26 | 96.301 | 0.033 | 11 | 1.195 | 389 |
| Glit light duty blue pad | 15.7275 | 3538.69 | 122.168 | 0.035 | 16 | 0.983 | 339 |
| Nox-Bellcow | 11.7984 | 2654.65 | 95.193 | 0.036 | 36 | 0.328 | 118 |
| Glit yellow pad | 11.5206 | 2592.14 | 94.415 | 0.036 | 12 | 0.960 | 350 |
| Glit 98 light duty white pad | 11.2428 | 2529.63 | 97.127 | 0.038 | 11 | 1.022 | 392 |
| 3M 98 pad | 11.9175 | 2681.44 | 109.901 | 0.041 | 12 | 0.993 | 407 |
| HF40 HS1S | 12.1556 | 2735.02 | 121.63 | 0.046 | 33 | 0.368 | 164 |
| Justinus-1 | 11.7984 | 2654.65 | 127.817 | 0.048 | 34 | 0.347 | 167 |
| 3M 90 pad | 12.1159 | 2726.09 | 157.764 | 0.058 | 12 | 1.010 | 584 |
| Rubbermaid Q800 | 12.7113 | 2860.03 | 237.507 | 0.083 | 9 | 1.412 | 1173 |
| HD stripe pad | 12.9097 | 2904.68 | 281.598 | 0.097 | 10 | 1.291 | 1252 |
| Tuway green pad | 11.6794 | 2627.86 | 280.528 | 0.107 | 12 | 0.973 | 1039 |

As noted in the test data, the preferred filter materials had a material density of about 0.036 to about 0.046. It is believed that the material density has some effect on drag, porosity, and absorbency. As such, through experimentation, the inventors discovered that a range of acceptable density values for the applicator pad according to various embodiments of the present invention of between about 0.01 $g/cm^3$ and about 0.08 $g/cm^3$ is desirable. A second narrower range of acceptable density values is between about 0.025 $g/cm^3$ and about 0.06 $g/cm^3$. A more preferable range of density values is between about 0.035 $g/cm^3$ and about 0.05 $g/cm^3$.

Thickness

Overall pad height can be another important material property for the applicator pads according to the present invention. As discussed below, a preferred range of heights or thicknesses can (1) provide better results over an uneven floor and (2) inhibit the finish from flowing over the top of the tool head 12 during use. The inventors have discovered that an applicator pad height according to some embodiments of the present invention of between about 0.3 cm and about 2.5 cm is desirable. In more preferred embodiments, the height is between about 0.6 cm and about 2.0 cm. The most preferred embodiments have a height of between about 0.9 cm and about 1.5 cm. All three filter materials HF 40, HF32D, and Nox materials described herein and tested were relatively thin. Multiple layers of these materials were used in testing to achieve the desired effect.

Compression Resistance

The inventors have also discovered that compression resistance is another material property that can be indicative of performance of the applicator pads. For example, it has been noted that the higher the compression resistance of a material, the floor finish applied tends to be more consistent and uniform in coat weight. One possible test to determine the compression resistance of a material is the ASTM D6571 test. This test includes multiple stages of adding and removing a mass from the pad to determine the compression of the subject material, and the relaxation of the material after the mass is removed. The following Table IV shows a summary of pad material sizes and mass values used during testing of the HF40 and other materials described above:

TABLE IV

| | Top/base plate | | Top plate | | Sample | | Mass | Mass per sample |
|---|---|---|---|---|---|---|---|---|
| | Cm * cm | $cm^2$ | Gram | per sample · g/cm2 | Cm * cm | $cm^2$ | Gram area $cm^2$ | $g/cm^2$ |
| ASTM D6571 | 23 × 23 | 529.0 | 187.0 | 0.47 | 20 × 20 | 400.0 | 7260 | 18.150 |
| Set-up #1 | 18 × 18 | 324.0 | 88.16 | 0.39 | 15 × 15 | 225.0 | 4073 | 18.102 |
| Set-up #2 | 18 × 18 | 324.0 | 89.11 | 0.40 | 15 × 15 | 225.0 | 4073 | 18.102 |

During the ASTM D6571 test described above, the initial pad height was measured, the pad height was measured again immediately after a mass was positioned on the pad, and then a third time after ten minutes elapsed with the mass on the pad. The mass was then removed, and the height was immediately measured, and was measured again after ten minutes without the mass on the pad. These steps (A to F indicated below) were measured followed the ASTM D6571 procedure, while the later steps (G' to J') were repeated for different time periods, which are modified from a true ASTM D6571 test (and noted on Table V with a prime symbol (')). For example, G' was measured after the mass was placed a third time over the pad for two hours, instead of twenty-four hours as specified in the test, and J' was taken after thirty minutes elapsed instead of one hour elapsed. The data collected from the test are included below in Table V:

TABLE VI

| Sample ID | 10 min L | M | 2 hr L-2 hr |
|---|---|---|---|
| Tuway green pad | 75 | 75 | 3.4 |
| Glit white pad | 83 | 83 | 4.2 |
| Rubbermaid Q800 | 79 | 78 | 4.1 |
| 3M90 | 84 | 86 | 0.7 |
| Ahlstrom HF 32D | 65 | 66 | 5.0 |
| Glit yellow pad | 83 | 85 | 6.2 |
| Glit tan pad | 80 | 81 | 4.2 |
| 3M98 | 74 | 75 | 3.0 |
| ETC thin Gorilla lite pad | 82 | 81 | 1.9 |
| Glit blue pad | 85 | 87 | 4.0 |
| HF40 HS1S | 75 | 77 | 2.9 |
| HD stripe pad | 74 | 78 | 7.1 |

TABLE V

| Summary of Data Height, inch | Initial No mass A | 0 min Mass B | 10 min Mass C | 0 min No mass D | 10 min No mass E | 0 min Mass F | 2 hr Mass G' | 0 min No mass H' | 30 min No mass J' |
|---|---|---|---|---|---|---|---|---|---|
| Tuway green pad | 4.6094 | 3.6875 | 3.4687 | 4.2969 | 4.4531 | 3.4531 | 3.3437 | 4.1406 | 4.2656 |
| Glit white pad | 4.4375 | 3.7031 | 3.6875 | 4.1719 | 4.2500 | 3.6406 | 3.5156 | 3.8906 | 4.1250 |
| Rubbermaid Q800 | 5.0156 | 4.2344 | 3.9687 | 4.7500 | 4.8125 | 4.0781 | 3.7500 | 4.4062 | 4.6719 |
| 3M90 | 4.7812 | 4.0937 | 4.0312 | 4.7031 | 4.7500 | 4.0781 | 4.0781 | 4.5156 | 4.6406 |
| Ahistrom HF 32D | 5.3437 | 3.5781 | 3.4844 | 4.1875 | 5.0781 | 3.5156 | 3.3437 | 4.5469 | 4.7969 |
| Glit yellow pad | 4.5469 | 3.8750 | 3.7500 | 4.1719 | 4.2656 | 3.8125 | 3.6250 | 3.9687 | 4.1562 |
| Glit tan pad | 5.1875 | 4.2344 | 4.1406 | 4.8437 | 4.9687 | 4.2656 | 4.0469 | 4.5781 | 4.7969 |
| 3M98 | 4.7031 | 3.5469 | 3.4844 | 4.4062 | 4.5625 | 3.5312 | 3.4375 | 4.2031 | 4.4062 |
| ETC thin Gorilla lite pad | 6.7656 | 5.5156 | 5.5469 | 6.5625 | 6.6406 | 5.5469 | 5.4062 | 6.4687 | 6.5625 |
| Glit blue pad | 6.2031 | 5.4844 | 5.2656 | 6.0312 | 5.9531 | 5.3594 | 5.1562 | 5.5000 | 5.7656 |
| HF40 HS1S | 4.7969 | 3.6719 | 3.6094 | 4.6250 | 4.6562 | 3.6094 | 3.5781 | 4.5781 | 4.5781 |
| HD stripe pad | 5.0937 | 3.9687 | 3.7656 | 4.6250 | 4.7344 | 3.8125 | 3.6875 | 4.5156 | 4.5781 |

Three variables were calculated from these results: L, M and L-2 hr. L is compression resistance, and is equal to one-hundred multiplied by the height of the sample stack (a stack of multiple layers) after the mass has been positioned on the sample stack for ten minutes, divided by the initial no-mass height. M is the elastic loss, and is equal to one hundred multiplied by the difference between the initial no-mass height and the relaxed height after ten minutes, all divided by the initial no-mass height. L-2 hr is compression resistance of the sample stack for the second time the mass is applied and after two hours have elapsed. Specifically, L-2 hr is equal to one hundred multiplied by the height after the mass has been applied for two hours divided by the recovered height after the mass has been removed for ten minutes. To summarize, the formulae are L=100*C/A, M=100*(A−E)/A, and L-2 hr=100*G'/E, as taken from Table V. A summary of the data, including calculated values L, M and L-2 hr, is included in Table VI below:

The data in Table VI indicate that the HF40 pad has a Compression Resistance of between about 75 and about 77, depending upon the length of time exposed to compression. Although these filter materials do not have the highest compression resistance test, the measured values are acceptable.

Liquid Absorptive Capacity

When an operator is finished polishing or finishing a floor, the operator typically lifts the tool 10 off the floor. It is desirable to have minimal fluid drip from the pad after being lifted off the floor. A property that illustrates the propensity of a material to drip or retain fluid (e.g., in the pad) is Liquid Absorptive Capacity (LAC). A test of LAC (Standard Test Method: WSP10.1(05) issued jointly by INDA and EDANA) includes submerging the material in fluid for one minute, and then removing the material and allowing the material to drip for two minutes. The mass of the dry sample (Mk) is measured before the test, and the mass of the wet sample is measured (Mn) after the test. The LAC parameter compares the mass of the dry sample (Mk) to the mass of the wet sample (Mn). The equation for the LAC in a percentage is LAC %=(Mn−Mk)*100%/Mk. With regard to the present invention, the test was repeated five times per sample material, and the LAC % was calculated. LACs for the various samples are included below in Table VII.

TABLE VII

| Sample | Lac, % - Average of 5 |
|---|---|
| HF32D | 929 |
| Daego disposable cloth | 1065 |
| HF40HS1S | 1362 |
| Justinus-1 | 1028 |
| Nox-Bellcow | 1185 |
| Glite-98, white | 231 |
| 3M-98, white | 274 |
| Americo white drive | 501 |

According to the results in Table VII, the HF40 sample had an average LAC % of 1362%, and the Nox sample had an average LAC % of 1185%. As illustrated, the air filter material had a LAC % higher than any of the other samples tested. The inventors have discovered that in some embodiments of the present invention, a high Liquid Absorptive Capacity may be desirable to promote better spreading of floor finishing material and/or inhibit dripping of floor polish. The inventors have discovered that applicator pad materials having a LAC of at least about 500% are desirable. However, the inventors have also discovered that such applicator pad materials having an LAC of at least about 900% are more desirable, Finally, the inventors have also discovered that such applicator pad materials having a LAC of at least about 1100% are most desirable (e.g., air filter materials such as the HF40 and Nox filter material).

Porosity

Another material property indicative of performance may be porosity. Theoretically, a less porous material should provide better application results. However, porosity must be sufficiently balanced with drag and LAC.

It is assumed the opacity can be relatively indicative of porosity. Opacity is the amount of light blocked by, or not allowed to pass through the material. Opacity can indicate the porosity of the material by measuring the void space in the material. The higher the opacity (i.e., amount of background blocked) of the material, the lower the porosity of the material. Thus, higher opacity values of an applicator pad material can correlate to lower material porosity. Lower levels of porosity of material usually gives better performance in consistent and uniform layer of floor finish to a floor. Accordingly, higher opacity values of an applicator pad material can be desired.

A modified WSP 60.4 "Standard Test method for Nonwoven Opacity" was used in testing applicator pad materials relevant to the present invention. To determine the opacity of several samples, the test measured the reflectance factor (lightness measurement, L) of a black area of a Leneta card (a chart with a combination of black and white areas large enough for wide aperture reflectance instrument measurement), and the reflectance factor (lightness measurement, Ls) of a single sheet of material to be tested placed on the same black area. Five samples of each material were tested, the L values for each sample were averaged, and then compared to the L value of the black sheet. The change in lightness measurement (Ls−L), the difference between the lightness measurement of the black sheet (L) and the lightness measurement of the samples (Ls), was measured and is included in Table VIII below. The thickness of each sample was also measured (see Table III), since opacity generally changes based upon the thickness (T) of the sample. Finally, the opacity was calculated using the equation (Ls−L)/T, and is included in Table VIII below. Note that for this test it is assumed the each material reflects light substantially equally.

TABLE VIII

| Sample | L-Readings | Change in L | Thickness | Change in L/cm |
|---|---|---|---|---|
| Black card | 32.472 | | | |
| HF 32D | 65.215 | 32.74 | 0.564 | 58 |
| HF 40HS1S | 76.596 | 44.12 | 0.368 | 120 |
| Justinus-1 | 81.211 | 48.74 | 0.347 | 140 |
| Nox-Bellcow | 75.538 | 43.07 | 0.328 | 131 |
| AM-white drive | 72.629 | 40.16 | Not measured | |
| Glit 98 white | 79.553 | 47.08 | 1.022 | 46 |
| 3M-98 white | 76.029 | 43.56 | 0.993 | 44 |
| Daego disposable pad | 83.492 | 51.02 | Not measured | |

The HF40 material described above had a change in opacity of about 120 L/cm and the Nox sample had a change of about 131 L/cm. The inventors have discovered that in some embodiments, opacity values no less than about 55 L per cm are desirable. In other embodiments, the inventors have discovered that desirable opacity values in applicator pad materials are no less than about 100 L per cm (e.g., polyester air filter materials such as the HF40 and Nox materials described above).

One interesting aspect observed by the inventors is that the high porosity material gave much better performance in applying an extra thick coat than applying a thin or regular thickness coating. The higher the porosity of the material, the thicker the coat of floor finish applied onto the floor. Accordingly, lower opacity values of pad material, such as HF 32D, can be desired if an extra thick coat is desired in the application.

Spreading

Another material property that can affect floor finish is spreading character. If spreading character is high, the applicator pad can more evenly distribute fluid over the floor surface. Samples of applicator pad materials relevant to embodiments of the present invention were tested with a modified version of the ASTM D 6702 Standard Test Method for Determining the Dynamic Wiping Efficiency of Nonwoven Fabrics Not Used in Cleanrooms. These samples were cut to have an area of 96 mm by 74 mm, and were attached to a weight block weighing 994 g to form a sample block. The sample block was placed on top of a white Vinyl Composite Tile (VCT) having two coats of finish already applied thereto. The longer edge of the sample block was aligned with the tile edge. A small percentage of dye was added to the floor finish to illustrate the spreading characteristics of the pad on the sample block. A fixed amount of floor finish with dye was placed in front of the sample block with a pipette. The sample block was then moved steadily toward an opposite side of the tile for about 3 to 4 seconds, and traveled a distance of about 225 mm. Two different concentrations of dye in floor finish were used (i.e. 0.02% and 0.05% dye in the floor finish). In a first test, 0.5 mL of finish was used, whereas 1 mL of finish was used in a second test, and 1.5 mL of finish was used in a third test.

The horizontal spreading pattern of each tested applicator pad material was measured (i.e. the width of the floor finish along the tile) to indirectly measure the spreading capacity of the tested material. The width of the floor finish that was spread on the tile was measured at the start of spreading the finish, in the middle of spreading the finish, and at the end of spreading the finish. The width of floor finish on the pad was also measured at various points, and the largest width was recorded. The spreading was calculated by dividing the largest width on the pad by the starting width on the tile. The end width on the tile was divided by the starting width on the tile to show how effectively the finish spread on the tile by each material. The results of this test are shown below in Table IX.

TABLE IX

| finish applied | marking in mm | HF 40HS1S 0.02% dye finish | HF 40HS1S 0.05% dye finish | avg of 2 | Glit 98 white 0.02% dye finish | Glit 98 white 0.05% dye finish | avg of 2 |
|---|---|---|---|---|---|---|---|
| 0.500 ml | On pad: largest width | 37 | 34 | 35.5 | 18 | 25 | 21.5 |
| | On tile: Length | ~225 | ~225 | | ~225 | ~225 | |
| | width-starting | 25 | 25 | | 24 | 25 | |
| | width-mid point | 39 | 30 | | 24 | 29 | |
| | width-end | 46 | 38 | | 20 | 30 | |
| spreading | Pad marking/start on tile | 1.48 | 1.36 | 1.42 | 0.75 | 1.00 | 0.88 |
| | On tile; end/start | 1.84 | 1.52 | 1.68 | 0.83 | 1.20 | 1.02 |
| | On tile; end/mid-point | 1.18 | 1.27 | 1.22 | 0.83 | 1.03 | 0.93 |
| 1.000 ml | On pad: largest width | 55 | 46 | 30 | 35 | 25 | 30 |
| | On tile: Length | ~225 | ~225 | | ~225 | ~225 | |
| | width-starting | 33 | 27 | | 34 | 27 | |
| | width-mid point | 51 | 43 | | 40 | 30 | |
| | width-end | 62 | 53 | | 40 | 30 | |
| spreading | Pad marking/start on tile | 1.67 | 1.70 | 1.69 | 1.03 | 0.93 | 0.98 |
| | On tile; end/start | 1.88 | 1.96 | 1.92 | 1.18 | 1.11 | 1.14 |
| | On tile; end/mid-point | 1.22 | 1.23 | 1.22 | 1.00 | 1.00 | 1.00 |
| 1.500 ml | On pad: largest width | 60 | 56 | 58 | 40 | 42 | 41 |
| | On tile: Length | ~225 | ~225 | | ~225 | ~225 | |
| | width-starting | 34 | 33 | | 37 | 34 | |
| | width-mid point | 50 | 50 | | 47 | 45 | |
| | width-end | 62 | 55 | | 47 | 45 | |
| spreading | Pad marking/start on tile | 1.76 | 1.70 | 1.73 | 1.08 | 1.24 | 1.16 |
| | On tile; end/start | 1.82 | 1.67 | 1.75 | 1.27 | 1.32 | 1.30 |
| | On tile; end/mid-point | 1.24 | 1.10 | 1.17 | 1.00 | 1.00 | 1.00 |

The data illustrate that the HF40 air filter material spreads floor finish more effectively than the Glit 98 white pad. One way to illustrate this is to compare the spreading end/start on tile value for each test, which divides the end width by the start width on the tile. The average value for the HF40 pad was 1.78, whereas the average value of the Glit pad was 1.15, as calculated from the values in Table IX. The values for the HF40 pad are higher than the values for the Glit pad, such that the floor finish is spread farther and in an improved manner by the HF40 pad.

Another way to illustrate spreading capability is to calculate the angle of finish spread between the starting point and the end point. The half amount of difference between the width of starting point and end point were divided by the length traveled, and the inverse tangent for the ratio was calculated. The angles of finish spread between the starting points and the mid-points were calculated in same manner, and are included in Table X below in the row entitled "First Half" along with the spread angles between starting points and the end points in the row entitled "Whole Run."

As the data in Table X illustrates, the spreading capability or angle of spread of the HF40 is superior to the Glit pad. Therefore, under the testing conditions, the HF40 pad more quickly and evenly spread floor finish than the Glit pad, as shown in Tables IX and X. The inventors have discovered that a material having an average spread angle of greater than about 2° (when the pad is not over-saturated) is advantageous and desirable in some embodiments of the inventive pad.

Leveling

Another material property that can affect floor finish is the leveling character of the applicator pad material. If the leveling character is high, the applicator pad can leave a relatively smooth coating on a floor. Theoretically, less abrasive and smoother material surfaces should provide better leveling performance. However, such surface characters should be sufficiently balanced with drag.

Unfortunately, the weight loss measurement from standard abrasive tests (such as the Schiefer value with 3 M/ST test method as described in U.S. Pat. No. 4,078,340, and weight loss measured with ASTM D1242 for Resistance of Plastic Materials to Abrasion) would be very small for suitable pad materials of low to non-abrasive characteristics. Therefore, the inventors utilized a modified method from ASTM D6279 for Rub Abrasion Mar Resistance of High Gloss Coatings. In particular, this method was adapted to measure the decrease of gloss reading caused by dragging pad materials over coated

TABLE X

| | | 0.02% dye finish | HF40HS1S 0.05% dye finish | Average of 2 runs | 0.02% dye finish | 0.05% dye finish | Glit 98 White Average of 2 runs |
|---|---|---|---|---|---|---|---|
| 0.500 ml | First Half | 3.6° | 1.3° | 2.4° | 0° | 1.0° | 0.5° |
| | Whole run | 2.7° | 1.6° | 2.2° | −0.5° | 0.6° | 0.1° |
| 1.000 ml | First Half | 4.6° | 4.1° | 4.3° | 1.5° | 0.8° | 1.1° |
| | Whole run | 3.7° | 3.3° | 3.5° | 0.8° | 0.4° | 0.6° |
| 1.500 ml | First Half | 4.1° | 4.3° | 4.2° | 2.5° | 2.8° | 2.7° |
| | Whole run | 3.6° | 2.8° | 3.2° | 1.3° | 1.3° | 2.0° |

tiles. In testing each material, a 4.5 inch diameter sample of material was moved while spinning at 50 rpm over coated tiles (Black Armstrong tiles with 6 coats of Signature® floor finish available from JohnsonDiversey, Inc., aged at room temperature for 3 weeks) under a set vertical force of 5 pounds (Z-force) using a Precision Force Instrument. To avoid effects of uneven drag (higher drag) at the beginning of pad movement, each pad was placed outside of the testing tile, moved over the entire length of tile to outside the opposite side of the testing area, and then moved in an opposite direction across the tiled testing area back to the starting position. In these tests, each pad was spun at 50 rpm during this whole testing cycle. Two pieces of each pad material were tested, and the gloss readings before and after the test were measured, and summarized in Table XI below.

TABLE XI

| | HF40 | | Glit 98 white | | 3M 5100 red pad | |
|---|---|---|---|---|---|---|
| | Smooth/abrasiveness By hand | | | | | |
| | Very smooth | | Slightly abrasive | | The most abrasive | |
| | #1 | #2 | #1 | #2 | #1 | #2 |
| Initial gloss - 20° | 72 | 71 | 70 | 68 | 69 | 69 |
| Initial gloss - 60° | 91 | 90 | 91 | 90 | 91 | 90 |
| final gloss - 20° | 70 | 70 | 63 | 63 | 57 | 59 |
| final gloss - 60° | 90 | 88 | 87 | 86 | 83 | 82 |
| Change in gloss Readings | ~1, not significant | 1 to 2, not significant | ~5 to 7 points | ~4 to 5 points | ~7 to 12 points | ~8 to 10 points |
| Visual observation Scratches on tile | No visual damage | No visual damage | Very lightly scratches | Very lightly scratches | Deeper scratches | Deeper scratches |

Among the three materials tested, the 3M 5100 red pad is the most abrasive, with a Schiefre Value of 0.1 gram (source: 3M product sheet). Based upon tests performed, the inventors have discovered that suitable pad materials should be less abrasive than the 3M red pad. As data in Table XI illustrates, the preferred pad material generates less than 10 points of gloss lost, or change in gloss readings. In more preferred embodiments, the gloss lost is less than about 5. In still more preferred embodiments, this gloss loss is less than about 2.

Applicator pads according to the various embodiments of the present invention have particular combinations of properties found by the inventors to provide superior performance results over conventional applicator pads for floor tools. Such properties include those described above for which testing was performed by the inventors. The inventors have discovered that certain combinations of properties (i.e., material and performance characteristics as described above) result in significant improvements compared to conventional floor finish tool applicator pads. One such combination is the wet coefficient of friction (whether dynamic-average, or static-first peak) and the LAC and/or opacity, particularly in the ranges referred to above. Another such combination is the pad material density and the LAC and/or thickness, particularly in the ranges referred to above. Yet another such combination is the pad material compression resistance and the pad material thickness and/or opacity, particularly in the ranges referred to above. Although polyester and other polymeric non-woven materials, such as air filter materials (e.g., HF40 or Nox air filter materials) have such desirable performance characteristic combinations, it will be appreciated that other materials having the above-described material and performance characteristics are possible, and fall within the spirit and scope of the present invention.

In some embodiments, the pad 44 can include fibers that can be monofilaments, yarns, tows, or bound filamentous materials. The materials that may be used as a floor finish distributing material are not limited to filament fibers, and can also includes webs, such as three dimensional fiberous webs, foams, flocked foam, and other sponge-like materials, needle punched material, open celled material, and the like. In some highly preferred embodiments, the floor finish distributing material is an open non-woven three-dimensional web formed of interlaced randomly extending flexible fibers, wherein the interstices between adjacent fibers are open, thereby creating a tri-dimensionally extending network of intercommunicated voids.

Examples of floor finish distributing materials for the applicator pad 44 include, but are not limited to, polypropylene and/or polyester fibers. Additional floor finish distributing materials include nonwoven materials such as, for example, the low density open non-woven fiberous materials described in U.S. Pat. No. 2,958,593, U.S. Pat. No. 4,355,067, and U.S. Pat. No. 4,893,439, and woven materials such as scrims and screens. Furthermore, other open structured materials including brushes having the above properties can be used. Substances suitable as floor finish distributing materials include, but are not limited to, polypropylene, polyethylene, polyesters, polyurethanes including modified polyurethanes, polyamides such as nylons, and mixtures and combinations thereof.

In operation, floor finish is delivered to the floor in bulk, and is distributed via the applicator pad. To spread floor finish on the floor, the applicator pad contacts the bulk floor finish deposited on the floor and spreads the bulk floor finish substantially evenly over the floor regardless of the pressure applied by the operator to the floor via the applicator pad. Substantially even spreading is accomplished by the material qualities of the applicator pad.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, many material properties were identified as providing ideal floor finish characteristics for the applicator pad 44. The present invention does not require a single pad to incorporate all of these properties. Rather, a pad having one or more of the properties (as described above) may be desired for a particular purpose.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A floor finish applicator pad, comprising:
a leading edge;
a trailing edge; and
a sheet having
a first side;
a second side opposite the first side and more fluid absorbent than the first side; and
a fold at least partially defining one of the leading and trailing edges of the applicator pad and having at least a double layer of the sheet, the fold further defining a first portion of the applicator pad in which the second side of the sheet is oriented to engage a floor surface;
wherein a second portion of the applicator pad is at least partially defined by the sheet, the first side of the sheet at the second portion oriented to engage the floor surface.

2. The floor finish applicator pad of claim 1, wherein the second side of the sheet is more fluid permeable than the first side.

3. The floor finish applicator pad of claim 1, wherein the first side of the sheet is smoother than the second side.

4. The floor finish applicator pad of claim 1, wherein the sheet is folded upon itself at the leading edge of the applicator pad to define a thickness of the leading edge that is greater than that of the trailing edge.

5. The floor finish applicator pad of claim 1, wherein:
the first side of the sheet is oriented to engage the floor surface is proximate the trailing edge of the applicator pad; and
the second side of the sheet is oriented to engage the floor surface is proximate the leading edge of the applicator pad.

6. The floor finish applicator pad of claim 1, wherein the sheet is a first sheet, the applicator pad further comprising a second sheet partially enclosed by the first sheet, wherein the second sheet has a first side and a second side, and wherein the first side of the second sheet is opposite to and less fluid absorbent than the second side of sheet.

7. The floor finish applicator pad of claim 1, wherein:
the applicator pad has opposite top and bottom surfaces; and
at least one of the top and bottom surfaces is stepped.

8. The floor finish applicator pad of claim 1, wherein the static coefficient of friction of the sheet according to ASTM D-2047 using a 3×3 inch sample of the sheet applied against a 12×12 inch black vinyl composite tile is less than about 0.32.

9. The floor finish applicator pad of claim 1, wherein the density of the sheet is greater than about 0.01 g/cm$^3$ and is less than about 0.08 g/cm$^3$.

10. The floor finish applicator pad of claim 1, wherein the sheet has a thickness greater than about 0.3 cm and less than about 2.5 cm.

11. The floor finish applicator pad of claim 1, wherein the sheet has a liquid absorptive capacity according to INDA and EDANA WSP10.1(05) of at least about 500%.

12. The floor finish applicator pad of claim 1, wherein the sheet comprises air filter material.

13. A floor finish applicator pad, comprising:
a body comprised of a sheet with a first side and a second side opposite the first side, the body having:
leading and trailing edges joined by lateral sides;
a ground-engaging surface; and
a fold at least partially defining one of the leading and trailing edges and having at least a double layer of the sheet such that at least a portion of each of the first side and the second side is oriented to engage a floor surface,
wherein the body comprises material having a density greater than about 0.01 g/cm$^3$ and less than about 0.08 g/cm$^3$.

14. The floor finish applicator pad of claim 13, wherein the fold defines a first portion of the body in which the second side is oriented to engage a floor surface, and wherein the body has a second portion at least partially defined by the first side oriented to engage the floor surface.

15. The floor finish applicator pad of claim 13, wherein the body further comprises a thickness greater than about 0.3 cm and less than about 2.5 cm.

* * * * *